US006339944B1

(12) United States Patent
Skalka

(10) Patent No.: US 6,339,944 B1
(45) Date of Patent: Jan. 22, 2002

(54) LOCKING MECHANISM FOR TRASH CAN RECEPTACLE AND OTHER DOORS

(75) Inventor: Gerald P. Skalka, Potomac, MD (US)

(73) Assignee: Victor Stanley, Inc., Dunkirk, MD (US)

( * ) Notice: Subject to any disclaimer, the term of this patent is extended or adjusted under 35 U.S.C. 154(b) by 0 days.

(21) Appl. No.: 09/568,157

(22) Filed: May 10, 2000

(51) Int. Cl.[7] ..... B65F 1/12

(52) U.S. Cl. ..... 70/63; 70/14; 70/275; 70/209

(58) Field of Search ..... 70/63, 14, 209, 70/225, 226, 237, 238

(56) References Cited

U.S. PATENT DOCUMENTS

| | | | | |
|---|---|---|---|---|
| 2,941,835 A | | 6/1960 | Musser | |
| 2,994,447 A | * | 8/1961 | Haynes | |
| 3,178,213 A | | 4/1965 | Nelson | |
| 3,346,288 A | | 10/1967 | Cosentino | |
| 3,582,169 A | * | 6/1971 | Koenig | 70/63 |
| 3,600,021 A | | 8/1971 | Hawkins | |
| 3,785,184 A | * | 1/1974 | Wirth | 70/63 |
| 3,862,555 A | * | 1/1975 | Wirth | 70/63 |
| 3,871,777 A | | 3/1975 | Sauer | |
| 3,912,311 A | | 10/1975 | Carvell et al. | |
| 3,989,267 A | | 11/1976 | Robinson | |
| 4,055,360 A | | 10/1977 | Russi | |
| 4,133,142 A | | 1/1979 | Dzus, Jr, | |
| 4,355,830 A | | 10/1982 | Rau, III | |
| 4,361,939 A | | 12/1982 | Gelula et al. | |
| 4,779,907 A | | 10/1988 | Yu | |
| 5,149,153 A | | 9/1992 | Drewry et al. | |
| 5,575,515 A | | 11/1996 | Iwamoto et al. | |
| 5,613,384 A | * | 3/1997 | Weber et al. | 70/209 |
| 5,628,148 A | | 5/1997 | Beutler | |
| 5,755,122 A | * | 5/1998 | Higginson | 70/209 |
| 5,881,583 A | * | 3/1999 | Booker et al. | 70/57 |
| 5,901,872 A | | 5/1999 | Zollinhofer et al. | |
| 5,997,056 A | | 12/1999 | Yamagishi et al. | |
| 6,007,116 A | | 12/1999 | Mott | |

* cited by examiner

*Primary Examiner*—William A. Cuchlinski, Jr.
*Assistant Examiner*—Olga Hernandez
(74) *Attorney, Agent, or Firm*—Jacobson Holman, PLLC

(57) ABSTRACT

A locking mechanism includes a housing assembly and a pin assembly movable relative to each other between open and closed positions. The housing assembly includes a housing, a flapper plate pivotably mounted in the housing, and a cylinder lock mounted in the housing. The housing has closed interior and exterior faces, closed top and bottom faces, an open side face facing the pin assembly, and a closed side face opposite the open side face. The flapper plate is pivotably mounted on a horizontal axis between the interior and exterior faces of the housing, and has a length whereby it can be pivoted upwards to bring its free edge toward the closed side face without contacting the closed side face. The lock is mounted in the exterior face of the housing, and includes a keyway for receiving a key on the exterior of the housing and a finger in the interior of the housing, the finger being rotatable with rotation of the key. The pin assembly includes a faceplate portion configured to cover at least a portion of the open side face of the housing when the housing and pin assemblies are in the closed condition, and a pin extending substantially perpendicularly from the faceplate portion towards the interior of the housing and positioned so as to extend into the interior of the housing and contact the flapper plate with the hook engaging the free end of the flapper plate when the housing assembly and the pin assembly are in the closed position. The finger has a length sufficient to engage the flapper plate and pivot it into a position in which the free edge of the flapper plate is raised above the hook of the pin assembly when the rotor is rotated to bring the finger into a vertical position.

22 Claims, 5 Drawing Sheets

LOCKING MECHANISM FOR TRASH CAN RECEPTACLE AND OTHER DOORS

BACKGROUND OF THE INVENTION

1. Field of the Invention

The present invention relates to a locking mechanism for trash can receptacles and other like doors. More specifically, the invention relates to a locking mechanism that is mechanically simple, so as to have few moving parts subject to breakage, and is also vandal-resistant.

2. Related Art

For esthetic reasons, trash cans intended for outdoor use are often put in decorative receptacles. These receptacles are provided with doors, so that the trash cans can be removed for emptying and then replaced. In order to prevent theft of the trash cans from the receptacles, the doors are provided with locking mechanisms. However, in a conventional locking mechanism such common sliding bolt, in which a bolt extends outwardly from the door, if the door is accidentally closed while the bolt is in the locked position, the bolt may be damaged on impact with the body of the receptacle, rendering the locking mechanism inoperative. Also, if the door hinges become misaligned, most conventional locking mechanisms will become inoperative due to misalignment between the bolt and the catch, hasp, or strike plate. Further, in most locking mechanisms of the type used in trash can receptacles, the locking mechanism is not protected against vandalism. It is to the solution of these and other problems that the present invention is directed.

SUMMARY OF THE INVENTION

It is therefore a primary object of the invention to provide a locking mechanism for doors that will not be damaged if the door is accidentally shut when the mechanism is in the locked position.

In is another object of the invention to provide a locking mechanism for doors that will remain operative even if the hinges become misaligned.

It is still another object of the invention to provide a locking mechanism for doors that is vandal resistant.

It is still another object of the invention to provide a locking mechanism in which some parts of the mechanism can be replaced if vandalized or otherwise damaged.

These and other objects of the invention are achieved by provision of a locking mechanism having a locked and an unlocked condition, comprising a housing assembly and a pin assembly movable relative to each other between open and closed positions. The housing assembly includes a housing, a flapper plate pivotably mounted in the housing, and a cylinder lock mounted in the housing.

The housing has closed interior and exterior faces, closed top and bottom faces, an open side face facing the pin assembly, and a closed side face opposite the open side face. The flapper plate is pivotably mounted on a horizontal axis between the interior and exterior faces of the housing, and has a length whereby it can be pivoted upwards to bring its free edge toward the closed side face without contacting the closed side face.

The lock is mounted in the exterior face of the housing. It includes a keyway for receiving a key on the exterior of the housing and a finger in the interior of the housing, the finger being rotatable with rotation of the key.

The pin assembly includes a faceplate portion configured to cover at least a portion of the open side face of the housing, and a pin extending substantially perpendicularly from the faceplate portion towards the interior of the housing and positioned so as to extend into the interior of the housing and contact the flapper plate with the hook engaging the free end of the flapper plate when the housing assembly and the pin assembly are in the closed position.

The finger has a length sufficient to engage the flapper plate and pivot it into a position in which the free edge of the flapper plate is raised above the hook of the pin assembly when the rotor is rotated to bring the finger into a vertical position. The lock is positioned relative to the open side face of the housing such that the finger does not extend beyond the open side face when the finger is in a horizontal position.

In one aspect of the invention, the housing assembly further comprises a horizontal shaft rotatably mounted between the interior and exterior faces, wherein the flapper plate extends from the shaft.

In another aspect of the invention, the flapper plate has a width slightly less than the interior width of the housing and a length whereby it can be pivoted horizontally toward the closed side face without contacting the closed side face.

In still another aspect of the invention, the locking mechanism further comprises a rotor extending into the interior of the housing, the rotor being rotatable in response to rotation of a key inserted into the keyway, and wherein the finger is mounted to the free end of the rotor for rotation with the rotor. Alternatively, a latch can be used instead of a keyed lock; and the finger can be normally biased in the horizontal position so that the pin will lock behind the flapper plate when the door is closed, and turning the latch will rotate the finger into the vertical position to release the pin from the flapper plate.

In still another aspect of the invention, the interior face, the top and bottom face, and the closed side face are all formed from a single piece of material, and the exterior face is formed separately and is removably attached to the top and bottom faces and the closed side face. In this aspect of the invention, the edges of the top and bottom faces and the closed side face adjacent the exterior face preferably are provided with lips to which the exterior face can be joined.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
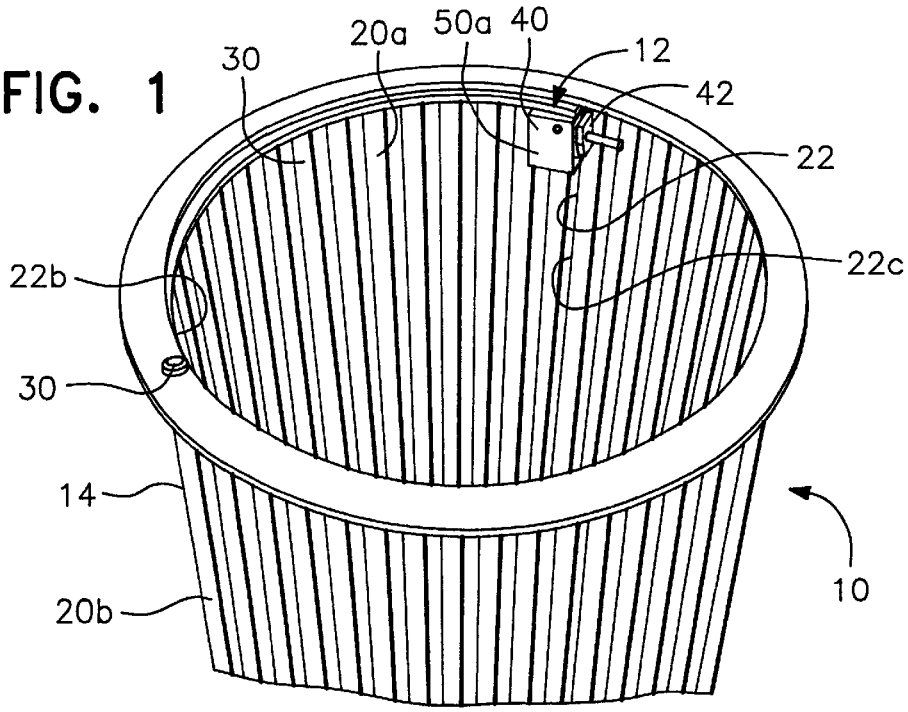
FIG. 1 is a partial perspective view of a trash can receptacle having a locking mechanism in accordance with the invention mounted thereon.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 2:
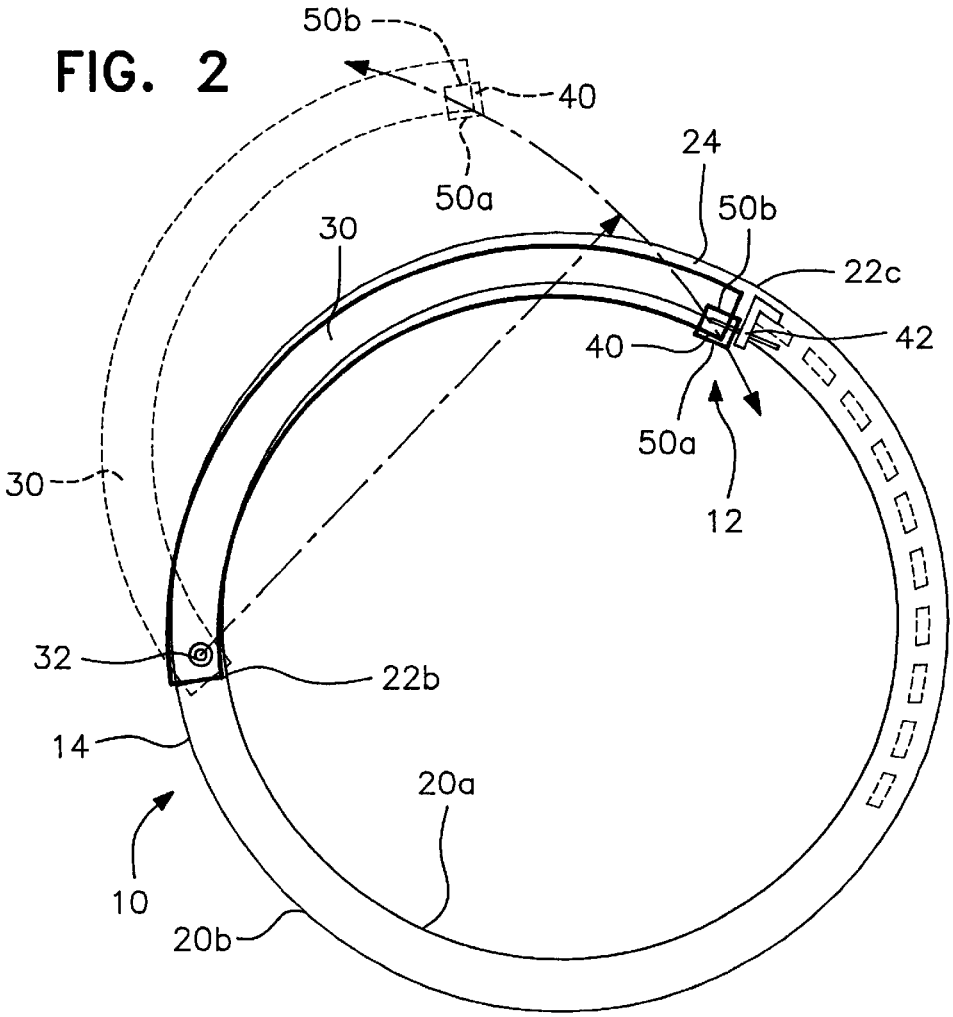
FIG. 2 is a top plan diagrammatic view of the trash can receptacle of FIG. 1.

Referring now to FIGS. 1 and 2, there is shown a trash can receptacle 10 (with its cover removed) incorporating a locking mechanism 12 in accordance with the invention. The trash can receptacle 10 includes a body 14 having an interior surface 20*a*, an exterior surface 20*b*, and a door frame 22 with a top 22*a*, a bottom (not shown), and first and second sides 22*b* and 22*c* defining a door opening 24. A door 30 is pivotably mounted on one of the sides 22*b* by conventional hinges or bearings 32. Although the trash can receptacle 10 illustrated in FIGS. 1 and 2 has a circular cross-section, it will be appreciated by those of skill in the art that the trash can receptacle 10 can have other configurations, such as a rectangular cross-section, and still incorporate the locking mechanism 12 in accordance with the present invention, as long as the arc of travel of the door 30 is adequate, as described in greater detail hereinafter. Also, it will be appreciated that the locking mechanism 12 can be incorporated into other structures having a door pivotably mounted in a door opening.

The locking mechanism 12 comprises a housing assembly 40 and a pin assembly 42 that are movable relative to each other. Preferably, the housing assembly 40 is mounted on a movable object, in the case of FIG. 1, the unhinged side of the door 30; and the pin assembly 42 is mounted on a fixed object, in the case of FIG. 1, the door frame side 22*c* facing the unhinged side of the door 30, opposite the housing assembly 40.

Referring now to FIGS. 3–8, the housing assembly 40 includes a housing 50 having closed interior and exterior faces 50*a* and 50*b*, closed top and bottom faces 50*c* and 50*d*, an open side face 50*e* substantially aligned with the unhinged side of the door 30, and a closed side face 50*f* opposite the open side face 50*e*. The housing assembly 40 is mounted with the exterior face 50*b* accessible from the interior surface of the door 30, while the remainder of the housing 50 extends into the interior of the trash can receptacle 10. Preferably, although not necessarily, the exterior face 50*b* is flush with the exterior surface of the door. Alternatively, for example, the exterior face 50*b* can be inset from the exterior surface of the door. Also, although the housing assembly 40 is shown as being positioned at the top of the door 30, it can be located further down the unhinged side of the door 30.

Preferably, the interior face 50*a*, the top and bottom faces 50*c* and 50*d*, and the closed side face 50*f* are all formed from a single piece of material, while the exterior face 50*b* is formed separately and attached to the top and bottom faces 50*c* and 50*d* and the closed side face 50*f* by removable fasteners 52 such as screws, for a purpose to be described hereinafter. To this end, the edges of the top and bottom faces 50*c* and 50*d* and the closed side face 50*f* adjacent the exterior face are provided with lips 54 to which the exterior face 50*b* can be joined. The housing 50 is removably mounted to the trash can receptacle 10 by fasteners (not shown), preferably rivets. Alternatively, the housing 50 also can be mounted to the trash can receptacle 10 by other fastening means, such as bolts or by tack-welding.

Figure 3:
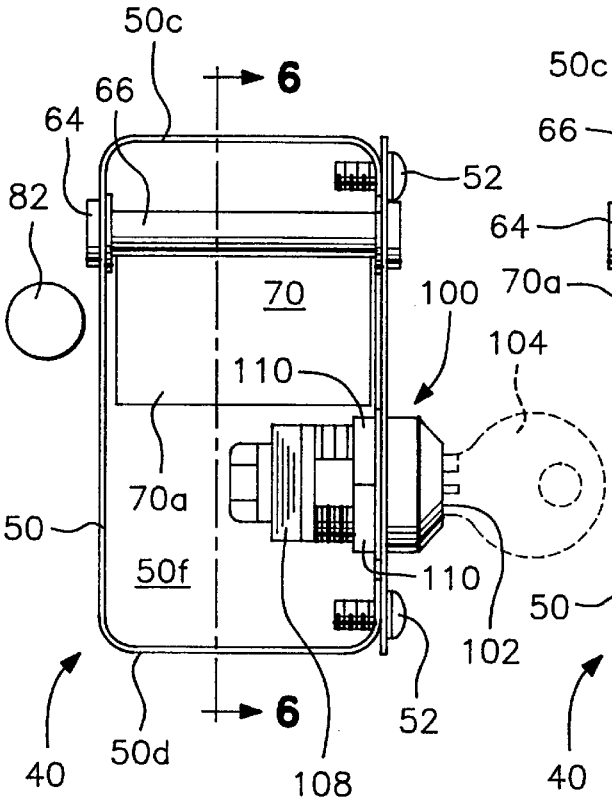
FIG. 3 is a side elevational view of the housing assembly and the pin of the pin assembly, with the lock in the locked position and the elements positioned as when the door is partially closed.
Figure 4:
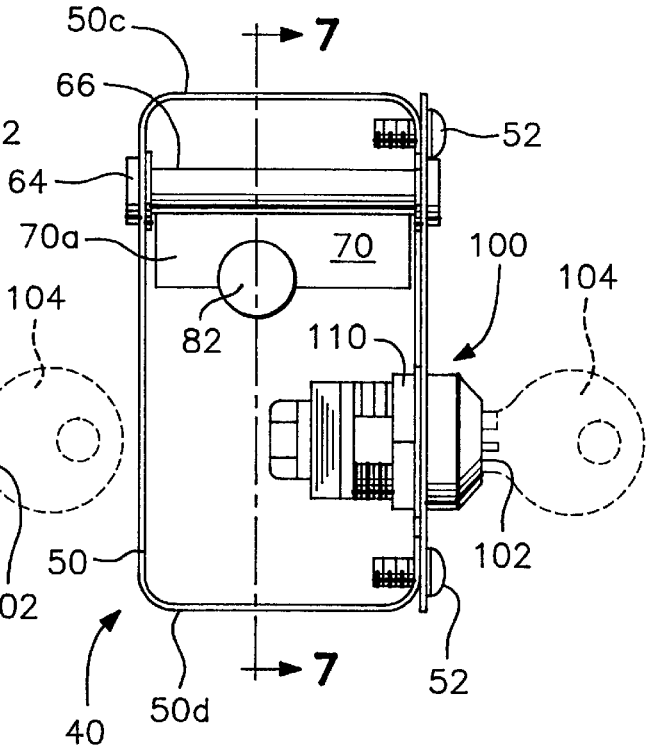
FIG. 4 is a side elevational view of the housing assembly and the pin of the pin assembly, with the lock in the locked position and the elements positioned as when the door is fully closed.
Figure 7:
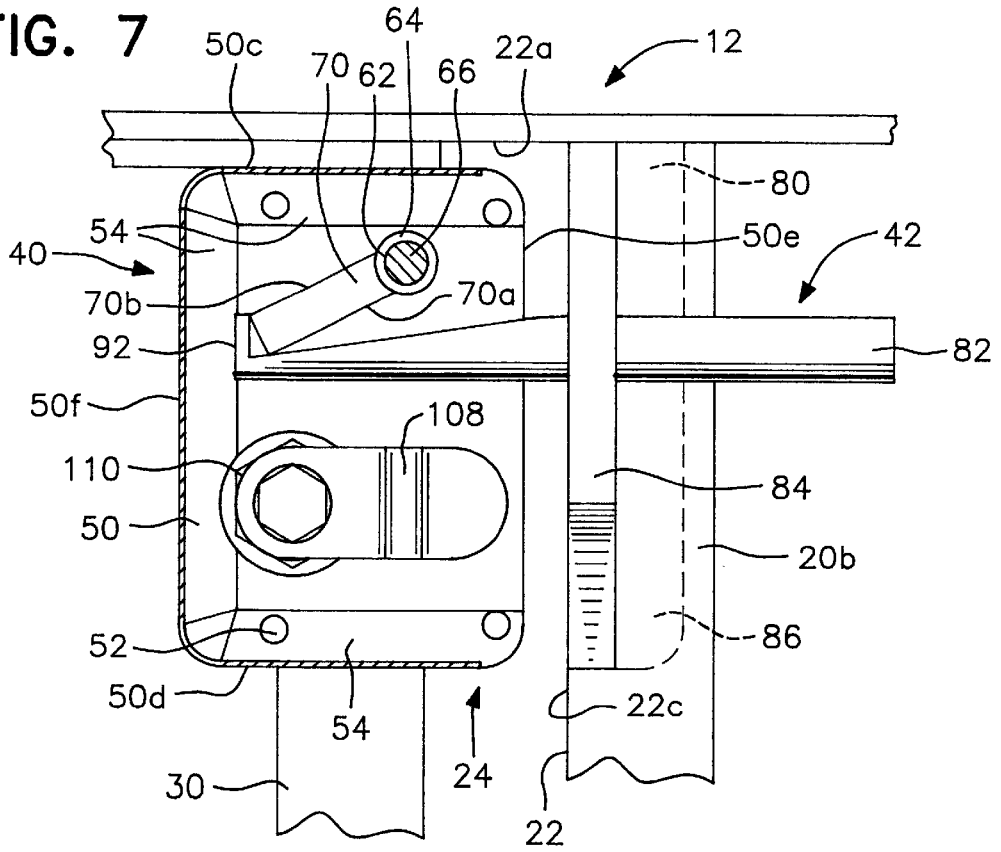
FIG. 7 is a cross-sectional view taken along line 7—7 of FIG. 4.

Opposed apertures 62 are formed in the 50*a* and 50*b* inset inwardly from the open side face 50*e* and downwardly from the top face 50*c*. These apertures 62 are fitted with bushings 64, and a horizontal shaft 66 is rotatably mounted in the bushings 64. A flapper plate 70 extends from the shaft 66. The flapper plate 70 can be unitarily formed with the shaft 66, or formed as a separate piece welded to the shaft 66. As best shown in FIGS. 3, 4, and 7, the flapper plate 70 has a width slightly less than the interior width of the housing 50 and a length less than the distance between the shaft 66 and the closed side face 50*f*, so that the flapper plate 70 can be pivoted toward the closed side face 50*f* without contacting the closed side face 50*f*. Preferably, the housing 50, the shaft 66, and the flapper plate 70 are all made of stainless steel.

The flapper plate 70 has exterior and interior faces 70*a* and 70*b* that respectively face the exterior and the interior of the housing 50 when the flapper plate 70 is hanging freely, and a free edge 70*c* opposite the shaft 66. If the flapper plate 70 or the shaft 66 requires replacement, the flapper plate 70 and shaft 66 can be removed from the housing 50 by removing the exterior face of the housing 50.

As best shown in FIGS. 2 and 6–8, the pin assembly 42 comprises a bracket 80 and a pin 82 mounted to the bracket 80. The bracket 80 in transverse cross-section is substantially L-shaped, with a faceplate portion 84 and a mounting portion 86. The mounting portion 86 is a generally planar plate that is attached, for example by welding, to the exterior of the trash can receptacle 10. The faceplate portion 84 also is a generally planar plate, which extends from the mounting portion 86 into the interior of the trash can receptacle 10, and which is configured to cover at least a portion of the open side face 50*e* of the housing 50 when the door 30 is in the closed position. The pin 82 extends substantially perpendicularly from both sides of the faceplate portion 84. On one side of the faceplate portion 84, the pin 82 protrudes into the door 30 opening so as to extend into the interior of the housing 50 immediately below the shaft 66 when the door 30 is in the closed position. On the other side of the faceplate portion 84, the pin 82 rests against the interior surface 20*a* of the body 14 of the trash can receptacle 10. The pin 82 is rigid, and is welded to the facing surface of the trash can receptacle 10. Preferably, the pin 82 and bracket 80 are powder-coated, galvanized steel.

As shown in FIGS. 3–8, the pin 82 is cylindrical, with a flattened, downwardly-angled, notch 90*a* formed in the upper surface 90*b* adjacent the free end to define a hook 92 at the free end of the pin 82. However, it will be appreciated that the pin 82 can have configurations other than cylindrical, and that the hook 92 can be defined other than by a notch 90*a* in the upper pin surface 90*b*.

The pin assembly 42 is positioned vertically relative to the housing assembly 40 so that the hook 92 will strike the exterior face of the flapper plate 70 above its free edge 70*c* when the flapper plate 70 is hanging freely. As the door 30 is pivoted closed, the hook 92 travels inward towards the closed side face 50*f* of the housing 50 and contacts the exterior face of the flapper plate 70, causing the flapper plate 70 to pivot upwardly. Because of the arc of travel of the door 30, and particularly the arc of travel of its unhinged side, the pin 82 approaches the housing 50 in a horizontal plane and first contacts the exterior face 70*a* of the flapper plate 70 just inside the interior face 50*a* of the housing 50. The width of the flapper plate 70 ensures that the hook 92 will contact the exterior face 70*a* of the flapper plate 70 even though the pin 82 is initially off-center in the horizontal plane relative to the flapper plate 70. The pin 82 is of such length relative to the flapper plate 70 that when the door 30 is in the fully closed position, with the faceplate portion 84 of the pin assembly 42 positioned opposite the open side face 50*e* of the housing 50, the hook 92 engages against the free edge 70*c* of the flapper plate 70, as shown in FIG. 7.

A conventional cylinder lock 100 is mounted in the exterior face of the housing 50 inset upwardly of the bottom face and inwardly of the closed side face 50*f*. The cylinder lock 100 has a keyway 102 on the exterior of the housing 50 for receiving a key 106, and a rotor (not shown) extending into the interior of the housing 50, the rotor being rotatable in response to rotation of the key 104 in the keyway 102. A finger 108 is mounted to the free end of the rotor for rotation with the rotor.

Figure 8:
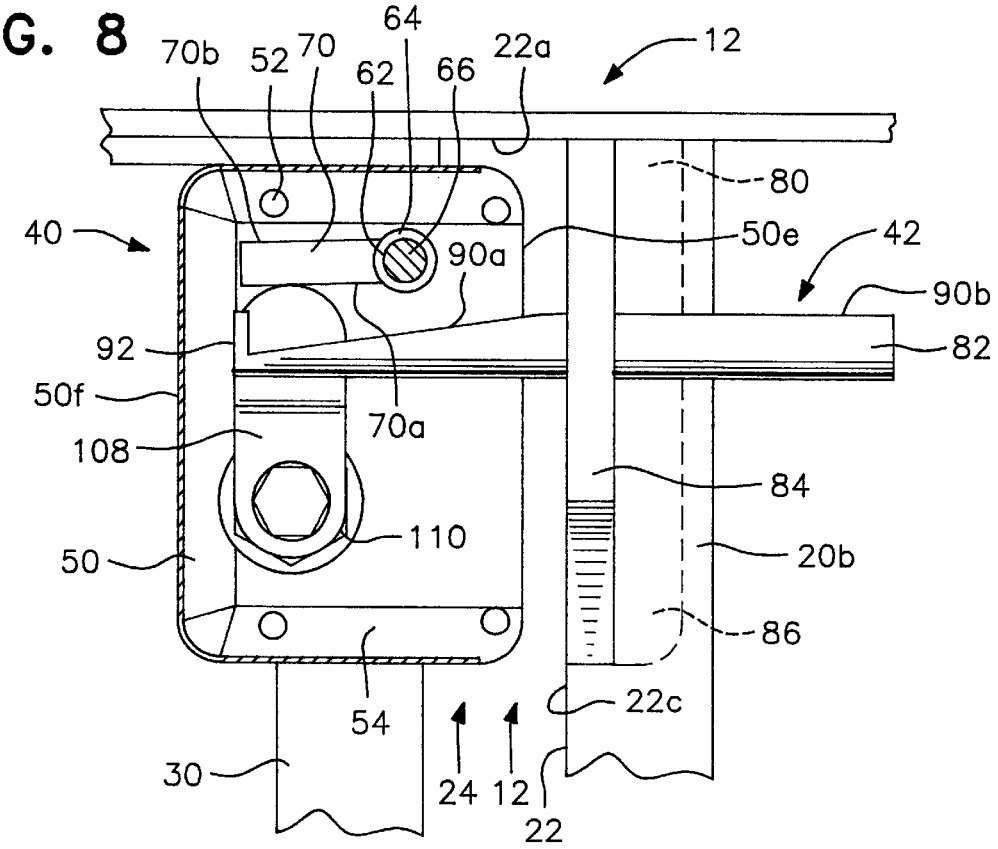
FIG. 8 is a cross-sectional view taken along line 8—8 of FIG. 5.

The finger 108 has a length sufficient to engage the flapper plate 70, and pivot it into a position in which its free edge 70*c* is raised above the hook 92 when the rotor is rotated to bring the finger 108 into a vertical position, as shown in FIG. 8, for a purpose to be described hereinafter.

The cylinder lock 100 is removably retained in the exterior face 50*b* of the housing 50 by, for example, a retaining nut 110. If the cylinder lock 100 is damaged, the exterior face 50*b* can be detached from the housing 50 and the cylinder lock 100 can be replaced.

The cylinder lock 100 has a locked position, in which the pin 82, once inserted into the housing 50, cannot be removed; and an unlocked position, in which the pin 82, if inserted into the housing 50, can be removed, as will be described in greater detail hereinafter. When the cylinder lock 100 is in the locked position, the finger 108 extends horizontally towards the open side face 50*e* of the housing 50, allowing the flapper plate 70 to hang freely; and when the cylinder lock 100 is in the unlocked position, the finger 108 extends vertically towards the top face of the housing 50 so that the free edge 70*c* of the flapper plate 70 is raised above the hook 92, as shown in FIG. 8. It will be appreciated that the cylinder lock 100 must be positioned relative to the open side face 50*e* of the housing 50 such that the finger 108 does not extend beyond the open side face 50*e* when the cylinder lock 100 is in the unlocked position.

As the door 30 is closed, the pin 82 travels into the interior of the housing 50 and the hook 92 contacts the exterior face of the flapper plate 70, causing the flapper plate 70 to pivot upwardly. As the pin 82 travels farther into the interior of the housing 50, the hook 92 moves towards the free edge 70*c* of the flapper plate 70. When the hook 92 clears the free edge 70*c* of the flapper plate 70, gravity causes the flapper plate 70 to drop into contact with the upper surface of the pin 82, locking the hook 92 between the free edge 70*c* of the flapper plate 70 and the back face of the housing 50. The pin 82 cannot be withdrawn from the housing 50 until the hook 92 is freed from the flapper plate 70. To this end, the cylinder lock 100 can be moved into the unlocked position.

As the key 104 is rotated into the unlocked position, the rotor also rotates, and with it, the finger 108, which rotates from a horizontal to a vertical position. As the finger 108 rotates upwardly towards the vertical, it contacts the exterior face of the flapper plate 70 and causes it to rotate upwards to a position in which the free edge 70*c* of the flapper plate 70 clears the hook 92. Because of this arrangement, if the door 30 is accidentally closed when the cylinder lock 100 is in the locked position, the pin 82 will simply engage and lock behind the flapper plate 70 without damage to either the pin assembly 42 or the housing assembly 40.

Figure 9:
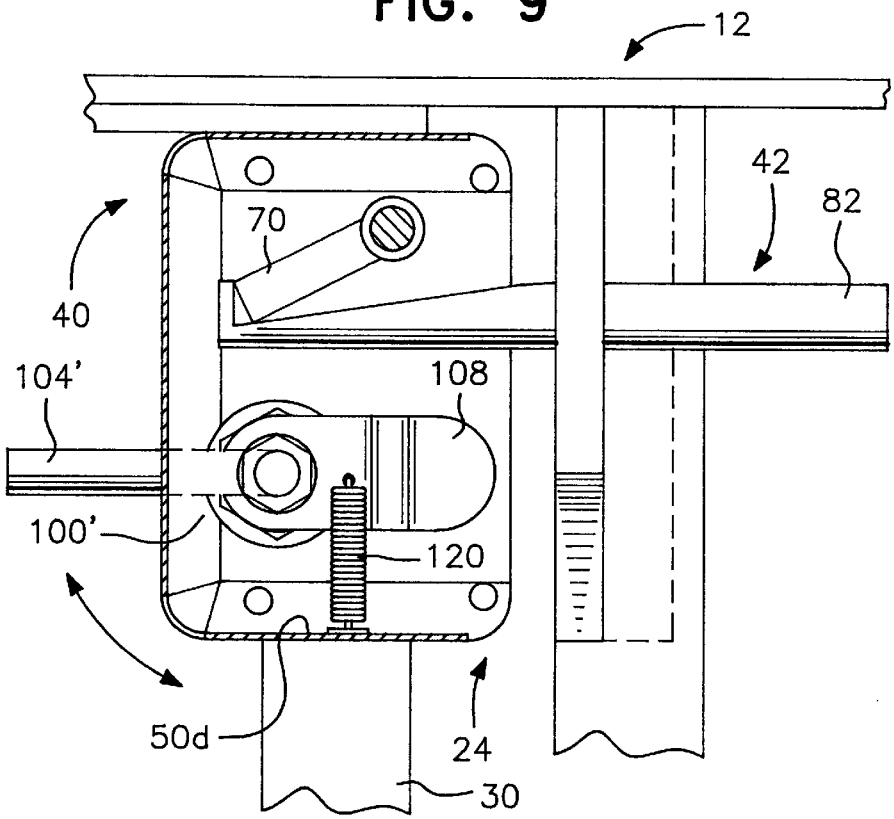
FIG. 9 is cross-sectional view showing an alternative embodiment of the locking mechanism in the locked condition.
Figure 10:
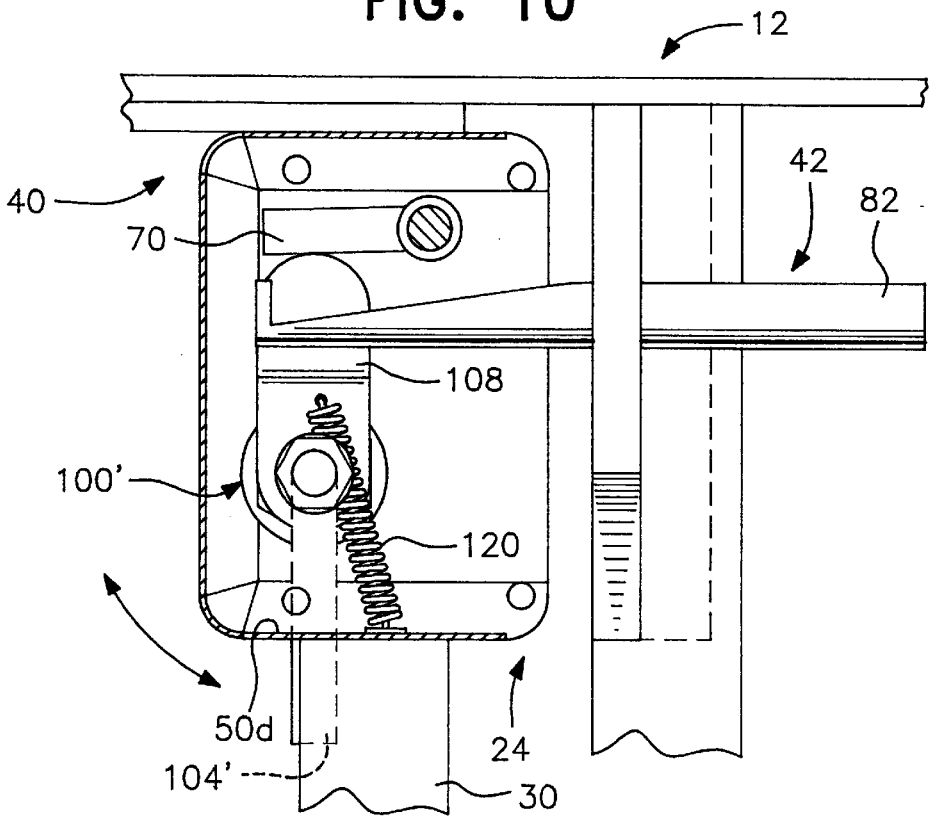
FIG. 10 is a cross-sectional view of the alternative embodiment of FIG. 9, with the locking mechanism in the unlocked condition.

Alternatively, as shown in FIGS. 9 and 10, a latch 100' can be used instead of the keyed cylinder lock 100. The latch 100' is constructed similar to the cylinder lock 100, except that a rotatable handle 104' replaces the key 104 and the keyway 102; and the finger 108 is normally biased in the horizontal position, for example by a tension spring 120 attached at one end to one face of the flapper plate 70 and at the other end to the bottom face 50*d*, so that the flapper plate 70 normally hangs freely and the pin 82 will lock behind the flapper plate 70 when the door 30 is closed. As will be appreciated by those of skill in the art, an appropriately positioned compression spring can be used in place of the tension spring 120. Turning the latch handle 104' causes rotation of the rotor and the finger 108 in the same manner as in the cylinder lock 100. Because the finger 108 is normally horizontal, turning the handle 104' will rotate the finger 108 into the vertical position to pivot the flapper plate 70 upward and release the pin 82 from the flapper plate 70.

It is noted that the faceplate portion 84 need not abut the open side face 50*e* of the housing 50 when the door 30 in the fully closed position. A gap can be present between the faceplate portion 84 and the open side face 50*e* of the housing 50, as long as the gap is small enough to prevent picking of the cylinder lock 100 therethrough. Similarly, the faceplate portion 84 need not cover the entire open side face 50*e* of the housing 50, as long as it covers enough of the open side face 50*e* to prevent picking of the cylinder lock 100. The gap between the faceplate portion 84 and the housing 50 is beneficial, in that it permits some play between the different parts of the locking mechanism 12 if the door 30 becomes misaligned.

It will be appreciated that the lock 100 must be positioned relative to the open side face 50*e* of the housing 50 such that the finger 108 does not extend beyond the open side face 50*e*; otherwise, the finger 108 would the faceplate portion 84 from seating properly opposite the open side face 50*e*.

Figure 5:
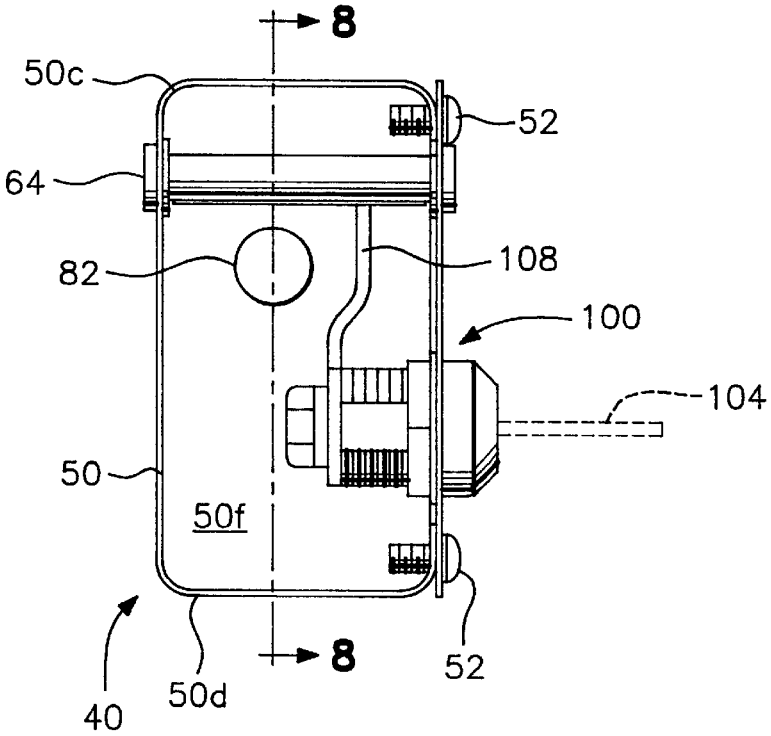
FIG. 5 is a side elevational view of the housing assembly and the pin of the pin assembly, with the lock in the unlocked position and the elements positioned as when the door is fully closed.
Figure 6:
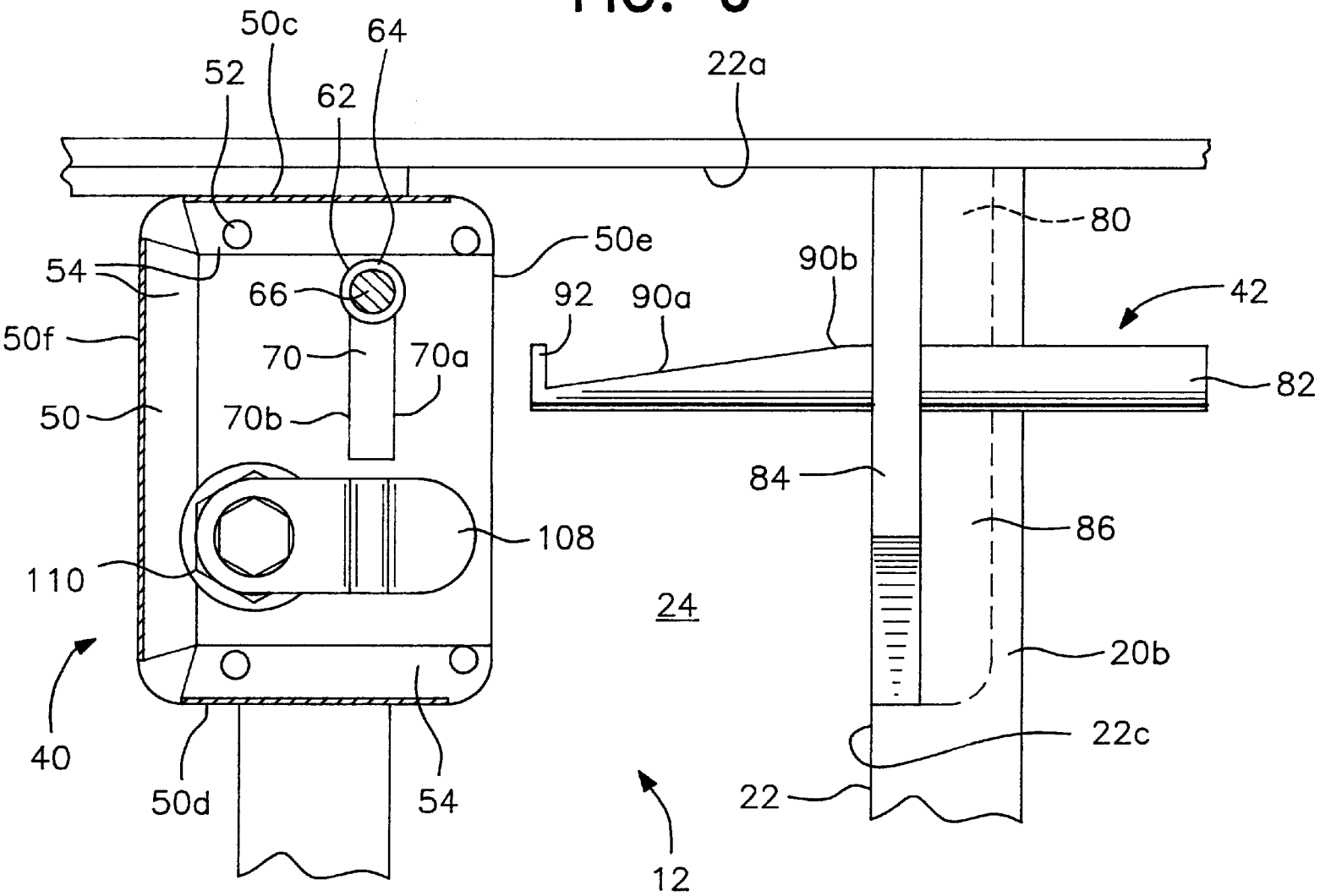
FIG. 6 is a cross-sectional view taken along line 6—6 of FIG. 3.

The pin 82 and the finger 108 are positioned relative to each other such that the finger 108 does not interfere with travel of the pin 82 into the housing 50. In the embodiment as illustrated in FIGS. 3–5, this is achieved by offsetting the finger 108 to towards the exterior face 50*b* of the housing 50, while positioning the finger 108 so that it substantially centered between the interior and exterior faces 50*a* and 50*b*.

As long as the finger 108 is disengaged from the flapper plate 70, the flapper plate 70 is free to pivot, so that when the door 30 is closed, gravity will cause the free edge 70*c* to rest against the notch 90*a* and lock behind the hook 92. The hook 92 cannot disengage from behind the free end of the flapper plate 70, effectively locking the door 30 in the closed position. However, if the cylinder lock 100 is turned so that the finger 108 is in the vertical position, the free edge 70*c* of the flapper plate 70 is raised above the hook 92, effectively unlocking pin 82 and allowing the door 30 to be opened. Furthermore, because the faceplate portion 84 covers the open side face 50*e* of the housing 50 when the door 30 is in the closed position, the locking mechanism is vandal resistant.

An advantage of the construction of the locking mechanism 12 is that it will not be damaged even if the door 30 is closed when the key 104 is turned to the locked position. This is because, as previously pointed out, the flapper plate 70 is free to rotate when the cylinder lock 100 is in the locked position.

In a trash can receptacle 10 of the type illustrated in FIG. 1, the hinges 32 are located so that the door 30 will swing along an arc that brings the open side face 50*e* of the housing 50 towards the pin 82 at an angle, thus allowing the pin 82 to clear the interior face of the housing 50 yet still engage the flapper plate 70 in the interior of the housing 50. It will be appreciated that the locking mechanism 12 in accordance with the invention can also be used with a sliding door. In that case, the pin 82 would enter the interior of the housing 50 head-on.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A locking mechanism having a locked and an unlocked condition, comprising:

a housing assembly and a pin assembly movable relative to each other between open and closed positions;

the housing assembly including:

a housing having closed interior and exterior faces, closed top and bottom faces, an open side face facing the pin assembly, and a closed side face opposite the open side face;

a flapper plate pivotably mounted on a horizontal axis between the interior and exterior faces of the housing, the flapper plate having a free edge and having a length whereby it can be pivoted upwards to bring the free edge toward the closed side face without contacting the closed side face; and means for pivoting the flapper plate upwards to bring the free edge toward the closed side face; and the pin assembly including:

a faceplate portion configured to cover at least a portion of the open side face of the housing; and a pin extending substantially perpendicularly from the faceplate portion towards the interior of the housing and positioned so as to extend into the interior of the housing and contact the flapper plate with the hook engaging the free end of the flapper plate when the housing assembly and the pin assembly are in the closed position.

2. The locking mechanism of claim 1, wherein the housing assembly further comprises a horizontal shaft rotatably mounted between the interior and exterior faces, wherein the flapper plate extends from the shaft.

3. The locking mechanism of claim 1, wherein the flapper plate has a width slightly less than the interior width of the housing and a length whereby it can be pivoted horizontally toward the closed side face without contacting the closed side face.

4. The locking mechanism of claim 1, wherein the means for pivoting comprises a lock mounted in the exterior face of the housing and having a keyway for receiving a key on the exterior of the housing and a finger in the interior of the housing, the finger being rotatable with rotation of the key; and wherein the finger has a length sufficient to engage the flapper plate and pivot it into a position in which the free edge of the flapper plate is raised above the hook when the key is rotated to bring the finger into a vertical position.

5. The locking mechanism of claim 4, wherein the lock further comprises a rotor extending into the interior of the housing, the rotor being rotatable in response to rotation of a key inserted into the keyway; and wherein the finger is mounted to the free end of the rotor for rotation with the rotor, and has a length sufficient to engage the flapper plate and pivot it into a position in which the free edge of the flapper plate is raised above the hook when the key is rotated to bring the finger into a vertical position.

6. The locking mechanism of claim 4, wherein the lock is positioned relative to the open side face of the housing such that the finger does not extend beyond the open side face when the finger is in a horizontal position.

7. The locking mechanism of claim 1, wherein the means for pivoting comprises a handle on the exterior face of the housing, a finger in the interior of the housing, the finger being rotatable between a horizontal and a vertical position with rotation of the handle, and means for normally biasing the finger in the horizontal position;

wherein the finger has a length sufficient to engage the flapper plate and pivot it into a position in which the free edge of the flapper plate is raised above the hook when the key is rotated to bring the finger into a vertical position.

8. The locking mechanism of claim 7, wherein the lock is positioned relative to the open side face of the housing such that the finger does not extend beyond the open side face when the finger is in a horizontal position.

9. The locking mechanism of claim 1, wherein the interior face, the top and bottom face, and the closed side face are all formed from a single piece of material, and wherein the exterior face is formed separately and removably attached to the top and bottom faces and the closed side face.

10. The locking mechanism of claim 9, wherein the edges of the top and bottom faces and the closed side face adjacent the exterior face are provided with lips to which the exterior face can be joined.

11. A locking mechanism having a locked and an unlocked condition, comprising:

a housing assembly and a pin assembly movable relative to each other;

the housing assembly including:

a housing having closed interior and exterior faces, closed top and bottom faces, an open side face facing the pin assembly, and a closed side face opposite the open side face;

a horizontal shaft rotatably mounted between the interior and exterior faces, a flapper plate extending from the shaft and hanging vertically due to gravity when the locking mechanism is in the unlocked condition, the flapper plate having a width slightly less than the interior width of the housing and a length less than the distance between the shaft and the closed side face, whereby the flapper plate can be pivoted horizontally toward the closed side face without contacting the closed side face;

a rotatable member extending into the interior of the housing;

a finger mounted to the rotatable member in the interior of the housing for rotation with the rotor; and means for rotating the finger between a horizontal position and a vertical position;

the pin assembly including:

a faceplate portion configured to cover at least a portion of the open side face of the housing; and a pin extending substantially perpendicularly from the faceplate portion towards the interior of the housing and positioned so as to extend into the interior of the housing immediately below the shaft when the housing assembly and the pin assembly are moved towards each other, the pin having a hook at its free end, whereby when the pin moves into the interior of the housing, it engages the flapper plate and causes the flapper plate to pivot upwardly, and when the faceplate portion is seated against the open side face of the housing, the hook engages against the free edge of the flapper plate;

wherein the finger has a length sufficient to engage the flapper plate and pivot it into a position in which the free edge of the flapper plate is raised above the hook when the rotor is rotated to bring the finger into a vertical position.

12. The locking mechanism of claim 11, wherein the means for pivoting the finger comprises a cylinder lock having a keyway, and wherein the rotatable member forms a part of the lock, the rotatable rotor being rotatable in response to rotation of a key inserted into the keyway.

13. The locking mechanism of claim 11, wherein the means for pivoting the finger comprises a handle on the exterior face of the housing, the rotatable member being rotatable with the handle; and wherein the housing assembly further includes means for normally biasing the finger in the horizontal position.

14. The locking mechanism of claim 11, wherein the interior face, the top and bottom face, and the closed side face are all formed from a single piece of material, and wherein the exterior face is formed separately and removably attached to the top and bottom faces and the closed side face.

15. The locking mechanism of claim 14, wherein the edges of the top and bottom faces and the closed side face adjacent the exterior face are provided with lips to which the exterior face can be joined.

16. The locking mechanism of claim 11, wherein the finger is positioned relative to the open side face of the housing such that the finger does not extend beyond the open side face when the finger is in a horizontal position.

17. A lockable structure comprising:

a body having a door frame with a top, a bottom, and first and second sides defining a door opening;

a door pivotably mounted on the first side of the door frame; and a mechanism having a locked and an unlocked condition and comprising a housing assembly and a pin assembly, one of the housing assembly and the pin assembly being mounted on the second side of the door frame and the other of the housing assembly and the pin assembly being mounted on the door;

the housing assembly including:

a housing having closed interior and exterior faces, closed top and bottom faces, an open side face facing the pin assembly, and a closed side face opposite the open side face;

a flapper plate pivotably mounted on a horizontal axis between the interior and exterior faces of the housing, the flapper plate having a free edge and having a length whereby it can be pivoted upwards to bring the free edge toward the closed side face without contacting the closed side face;

means for pivoting the flapper plate upwards to bring the free edge toward the closed side face; and the pin assembly including:

a faceplate portion configured to cover at least a portion of the open side face of the housing; and a pin extending substantially perpendicularly from the faceplate portion towards the interior of the housing and positioned so as to extend into the interior of the housing and contact the flapper plate with the hook engaging the free end of the flapper plate when the housing assembly and the pin assembly are in the closed position.

18. The lockable structure of claim 17, wherein the means for pivoting comprises a lock mounted in the exterior face of the housing and having a keyway for receiving a key on the exterior of the housing and a finger in the interior of the housing, the finger being rotatable with rotation of the key; and wherein the finger has a length sufficient to engage the flapper plate and pivot it into a position in which the free edge of the flapper plate is raised above the hook when the key is rotated to bring the finger into a vertical position.

19. The lockable structure of claim 18, wherein the lock further comprises a rotor extending into the interior of the housing, the rotor being rotatable in response to rotation of a key inserted into the keyway; and wherein the finger is mounted to the free end of the rotor for rotation with the rotor, and has a length sufficient to engage the flapper plate and pivot it into a position in which the free edge of the flapper plate is raised above the hook when the key is rotated to bring the finger into a vertical position.

20. The locking mechanism of claim 17, wherein the means for pivoting comprises a handle on the exterior face of the housing, a finger in the interior of the housing, the finger being rotatable between a horizontal and a vertical position with rotation of the handle, and means for normally biasing the finger in the horizontal position;

wherein the finger has a length sufficient to engage the flapper plate and pivot it into a position in which the free edge of the flapper plate is raised above the hook when the key is rotated to bring the finger into a vertical position.

21. The structure of claim 20, wherein the door has an arc-shaped profile.

22. The structure of claim 21, wherein the body has a circular cross-section.

* * * * *